US009402461B2

(12) United States Patent
Brik et al.

(10) Patent No.: US 9,402,461 B2
(45) Date of Patent: Aug. 2, 2016

(54) HEAD FOR AN ORAL CARE IMPLEMENT

(71) Applicant: The Procter & Gamble Company, Cincinnati, OH (US)

(72) Inventors: Andreas Brik, Kronberg (DE); Michael Machlitt, Schwalbach (DE); Armin Tschol, Frankfurt am Main (DE)

(73) Assignee: BRAUN GMBH, Kronberg (DE)

( * ) Notice: Subject to any disclaimer, the term of this patent is extended or adjusted under 35 U.S.C. 154(b) by 0 days.

(21) Appl. No.: 14/625,220

(22) Filed: Feb. 18, 2015

(65) Prior Publication Data

US 2015/0238004 A1 Aug. 27, 2015

(30) Foreign Application Priority Data

Feb. 21, 2014 (EP) ..... 14156164
Aug. 15, 2014 (EP) ..... 14181174

(51) Int. Cl.
*A46B 9/02* (2006.01)
*A46B 9/04* (2006.01)

(52) U.S. Cl.
CPC . *A46B 9/04* (2013.01); *A46B 9/025* (2013.01); *A46B 2200/1066* (2013.01)

(58) Field of Classification Search
CPC ..... A46B 9/025; A46B 9/04
See application file for complete search history.

(56) References Cited

U.S. PATENT DOCUMENTS 4,351,080 A * 9/1982 Grossman ..... A46B 5/02 15/143.1
D381,517 S * 7/1997 Sauro ..... D4/112
5,839,149 A 11/1998 Scheier et al.
6,058,541 A 5/2000 Masterman et al.
6,094,769 A * 8/2000 Driesen ..... A46D 1/00 15/167.1
6,141,818 A * 11/2000 Weihrauch ..... A46D 1/00 15/167.1
6,390,708 B1 * 5/2002 Gueret ..... A45D 34/045 15/207.2
2003/0115707 A1 * 6/2003 Buford, III ..... F02M 3/09 15/207.2

(Continued)

FOREIGN PATENT DOCUMENTS

DE 8202897 6/1982
EP 0453954 5/1994

(Continued)

OTHER PUBLICATIONS

International Search Report and Written Opinion, mail date May 29, 2015, 10 pages.

*Primary Examiner* — Randall Chin
(74) *Attorney, Agent, or Firm* — Vladimir Vitenberg

(57) ABSTRACT

A head for an oral care implement has a mounting surface and at least one twisted tuft including a plurality of filaments and having a base mounted on the mounting surface. The twisted tuft has an outer lateral surface, a longitudinal axis, a lower cross-sectional area extending in a plane that is perpendicular to the longitudinal axis and that is arranged at the base, and an upper cross-sectional area extending in a plane that is perpendicular to the longitudinal axis and that is arranged at the twisted tuft's free end. The lower cross-sectional area and the upper cross-sectional area have substantially the same shape and size. The filaments forming the outer lateral surface are substantially straight and inclined with respect to the longitudinal axis in either a clockwise direction or in a counterclockwise direction. The upper cross-sectional area is twisted relative to the lower cross-sectional area. The upper cross-sectional area is not congruent with the lower cross-sectional area when they are orthogonally projected onto each other along the longitudinal axis.

23 Claims, 4 Drawing Sheets

(56) References Cited

U.S. PATENT DOCUMENTS

| | | | | |
|---|---|---|---|---|
| 2003/0126704 | A1* | 7/2003 | Bailey-Teets | A46B 9/026 15/167.1 |
| 2004/0117930 | A1 | 6/2004 | Townley et al. | |
| 2004/0187244 | A1 | 9/2004 | Giertz | |
| 2010/0115724 | A1 | 5/2010 | Huang | |
| 2011/0258794 | A1 | 10/2011 | Headstrom et al. | |
| 2013/0007968 | A1 | 1/2013 | Driesen et al. | |

FOREIGN PATENT DOCUMENTS

| | | |
|---|---|---|
| EP | 2494885 | 9/2012 |
| JP | 4544789 | 9/2010 |
| WO | WO 2012096700 | 7/2012 |
| WO | WO 2012096701 | 7/2012 |

* cited by examiner

HEAD FOR AN ORAL CARE IMPLEMENT

FIELD OF THE INVENTION

The present disclosure is concerned with a head for an oral care implement and in particular with such a head comprising at least one twisted tuft of filaments extending from a mounting surface of the head.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

It is known that tufts are typically composed of filaments which extend substantially in the same direction in a substantially straight manner.

Further, tufts in the form of a generally planar array composed of a continuous mass of bristles which are fixed to a toothbrush head are also known in the art. The generally planar array of bristles may have a fan-shaped perimeter which extends across the upper surface of the toothbrush head in a transverse direction relative to a longitudinal axis of the head. Such tufts should help to guide brushing movement and should enable better conformity with recommended tooth brushing techniques during normal use.

While toothbrushes comprising these types of tufts clean the outer buccal face of teeth adequately, they are generally not as well suited to provide adequate removal of plaque and debris from the gingival margin, interproximal areas, lingual surfaces and other hard to reach areas of the mouth.

It is an object of the present disclosure to provide a head for an oral care implement which provides improved cleaning properties, for example with respect to interproximal and gingival marginal regions of teeth. It is also an object of the present disclosure to provide an oral care implement comprising such head.

SUMMARY OF THE INVENTION

In accordance with one aspect, a head for an oral care implement is provided that comprises:

a mounting surface, at least one twisted tuft comprising a plurality of filaments and having a base mounted on the mounting surface, the twisted tuft having an outer lateral surface, a longitudinal axis, a lower cross-sectional area extending in a plane that is perpendicular to the longitudinal axis and that is arranged at the base, and an upper cross-sectional area extending in a plane that is perpendicular to the longitudinal axis and that is arranged at the free end of the twisted tuft, the lower cross-sectional area and the upper cross-sectional area having substantially the same shape and size, wherein at least the filaments forming the outer lateral surface are each substantially straight and are all inclined with respect to the longitudinal axis in either a clockwise direction or in a counterclockwise direction, and the upper cross-sectional area is twisted with respect to the lower cross-sectional area by a twisting angle $\alpha$ and the upper cross-sectional area is not congruent with the lower cross-sectional area when they are orthogonally projected onto each other along the longitudinal axis.

In accordance with one aspect, an oral care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
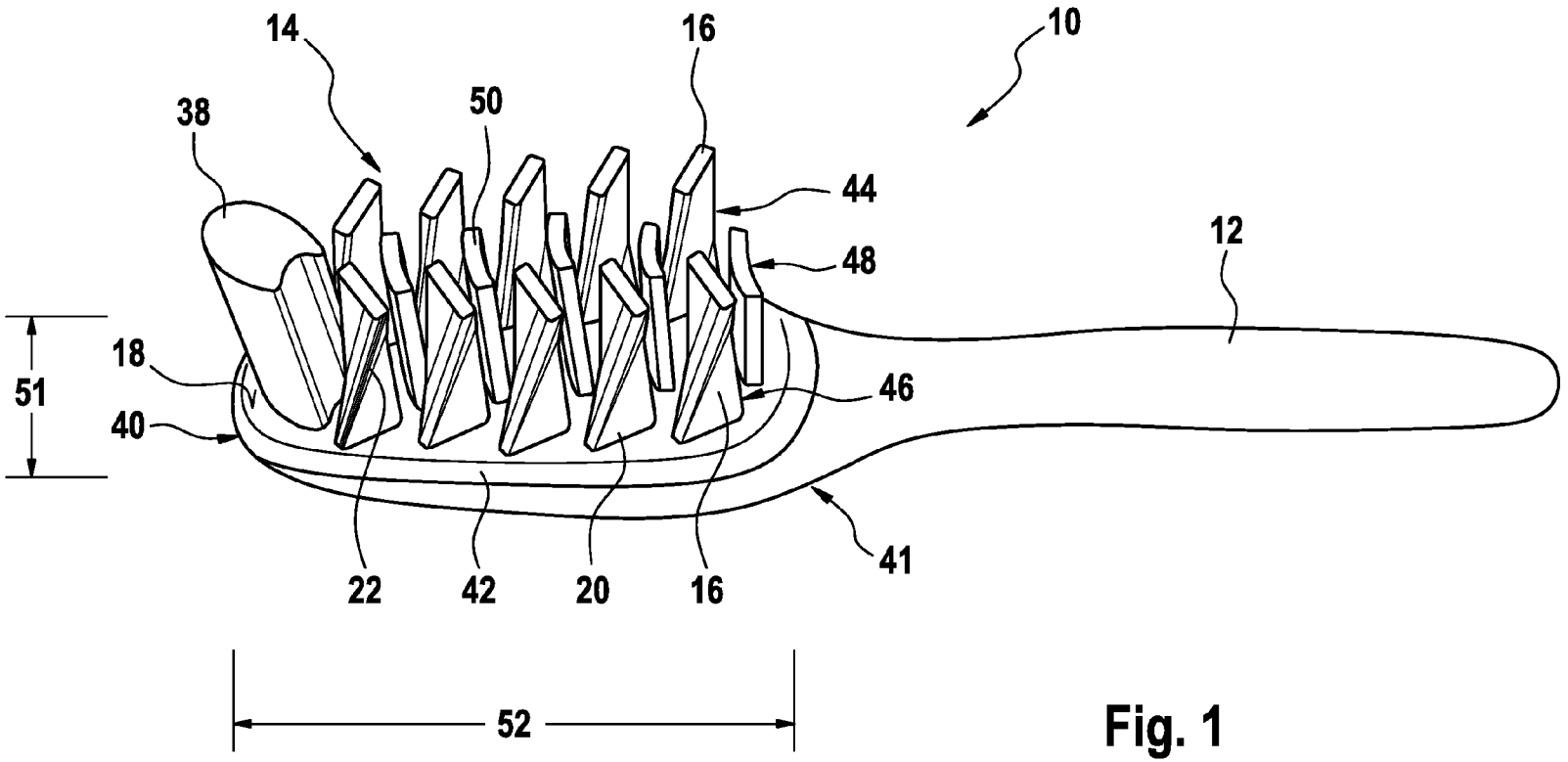
FIG. 1 shows a schematic perspective view of a first example embodiment of an oral care implement comprising a first example embodiment of a head.

A head for an oral care implement in accordance with the present disclosure comprises at least one twisted tuft comprising a plurality of filaments. The twisted tuft is mounted at its base on a mounting surface of the head.

The twisted tuft has an outer lateral surface, a longitudinal axis, an upper cross-sectional area and a lower cross-sectional area. In the context of this disclosure the term "outer lateral surface" means the face or surface of the twisted tuft on its sides, i.e. any face or surface that is not the bottom or top area of the twisted tuft. The term "longitudinal axis" of the twisted tuft is defined as the main extension of the twisted tuft and may generally extend through the center of both, the lower cross-sectional area and the upper cross-sectional area. The lower cross-sectional area is defined at the base of the twisted tuft, i.e. at the bottom area which is next/in close proximity to the mounting surface of the head and extends in a plane which is substantially perpendicular to the longitudinal axis. The upper cross-sectional area also extends in a plane which is substantially perpendicular to the longitudinal axis of the twisted tuft. The upper cross-sectional area is arranged opposite the base, i.e. at the free end of the twisted tuft, or in other words at the top area/loose end of the twisted tuft. In the context of this disclosure the term "twisted tuft" means a tuft having a lower and an upper cross-sectional area wherein the upper cross-sectional area is twisted with respect to the lower cross sectional area when the lower and the upper cross-sectional area are projected onto each other along the longitudinal axis of the twisted tuft. In other words, the upper cross-sectional area is distorted/rotated/turned around the longitudinal axis with respect to the lower cross-sectional area.

According to the present disclosure, the upper cross-sectional area and the lower cross-sectional area have substantially the same shape and size. When the upper and the lower cross-sectional area are orthogonally projected onto each other along the longitudinal axis of the twisted tuft, the upper cross-sectional area of the twisted tuft is not congruent with the lower cross-sectional area. In other words, when the twisted tuft is seen from a to-town view along its longitudinal axis, the upper cross-sectional area does not superpose the lower cross-sectional area.

At least the filaments which form the outer lateral surface of the twisted tuft extend from the mounting surface of the head in a substantially straight manner. They are inclined with respect to the longitudinal axis of the twisted tuft, either in a clockwise or in a counterclockwise direction, but not in both directions. This configuration of filaments provides the twisted tuft with an upper cross-sectional area being twisted with respect to the lower cross-sectional area by a twisting angle α.

In other words, the outer lateral surface of the twisted tuft has the configuration of a "non-planar ruled surface". In the context of this disclosure a surface is "non-planar ruled" if on every point on the outer lateral surface there is a substantially straight filament that lies on that surface. As the outer lateral surface of the twisted tuft is non-planar, the filaments forming that surface are substantially not parallel to each other. In other words, at least the filaments which form the outer lateral surface of the twisted tuft extend from the mounting surface of the head in a substantially straight manner, are all inclined and are substantially not parallel to one another.

The twisted tuft according to the present disclosure may improve cleaning properties of the head for an oral care implement, for example with respect to interdental areas and gingival marginal regions of the teeth, as the specific shape of the twisted tuft may facilitate the filaments adapting to the teeth's contour more easily/in a better manner. Further, the filaments may slide deeper into small gaps between the teeth to clean interdental areas/gaps and to remove plaque and other residues more effectively. The shape of the twisted tuft according to the present disclosure may assure access to narrow spaces as the stiffness of the twisted tuft may be increased due to the specific inclined arrangement of the filaments compared to tufts having a planar ruled lateral surface. In case pressure is applied to a tuft having a planar ruled lateral surface, e.g. in the course of a brushing action, the filaments may bend in a direction orthogonal to the direction of pressure, i.e. the filaments may bend away/may separate in a fan-shaped manner. In contrast thereto, in case pressure is applied to the filaments of the twisted tuft in accordance with the present disclosure, the filaments may rather de-twist or may twist further in the direction of inclination (depending on the direction of pressure) which may result in increased stiffness. The twisted tuft according to the present disclosure may allow higher contact pressure/pressing forces during a brushing action. Further, the de-twisting of the twisted tuft results in a tuft elongation which may facilitate the filaments reaching deeper into the interdenatal areas/gaps.

In some embodiments, the twisting angle α may be from about 1° to about 120°, optionally from about 50° to about 100°, further optionally about 90°. The higher the twisting angle α, the more the filaments are inclined with respect to the longitudinal axis of the twisted tuft which may lead to different cleaning properties. Depending on the direction of pressure applied to the twisted tuft during a brushing action, the filaments may either twist further in the direction into which they are inclined or may de-twist in the opposite direction. A de-twisting of the twisted tuft leads to a filament elongation. Such elongation may facilitate the filaments penetrating deeper into interdental areas and other hard to reach regions. Thus, a higher twisting angle α, for example of about 100° or alternatively of about 90°, may result in a larger tuft elongation compared to a lower twisting angle α of about 1° to about 50°. In case the filaments twist further in the direction of their inclination, the filaments may be prevented from spreading/bending away and the twisted tuft may be provided with increased stiffness. The increased stiffness of the twisted tuft may force the filaments to penetrate deeper into interdental areas which may result in improved interdental cleaning properties, for example when the head is moved along the okklusal, labial and bukkal surfaces of the teeth.

In some embodiments, the upper cross-sectional area and/or the lower cross-sectional area may have substantially the shape of a square, rectangle, triangle or oval. In some embodiments, the lower and the upper cross-sectional area each may have substantially the shape of a rectangle. In other words, both, the lower and the upper cross-sectional area may have a length extension and a width extension in their plane of extension. The length and the width extension are arranged perpendicular to each other and the length extension is longer than the width extension. As the upper cross-sectional area is twisted with respect to the lower cross-sectional area, both, the length extension and the width extension of the upper cross-sectional area are twisted with respect to the length and the width extension of the lower cross-sectional area, respectively. The filaments of the outer lateral surface which define the width extension of the lower cross-sectional area with the filament's base may define the width extension of the upper cross-sectional area with the filament's free ends. Vice versa, the filaments of the outer lateral surface which define the length extension of the lower cross-sectional area with the filament's base may define the length extension of the upper cross-sectional area with the filament's free ends.

In some embodiments, the head for an oral care implement may have a proximal end and a distal end. The proximal end is defined at the side of the head which is attached or attachable to a handle of an oral care implement whereas the distal end is defined at the opposite side of the proximal end, i.e. furthest away from the handle/at the loose/free end of the head. The extension between the distal end and the proximal end of the head may be defined as the longitudinal extension of the head. A longitudinal brushing direction is defined by a brushing movement in the direction towards the distal end or towards the proximal end of the head, i.e. along the longitudinal extension of the head.

In some embodiments, the lower and the upper cross-sectional area each may have substantially the shape of a rectangle. The length extension of the lower cross-sectional area may be substantially parallel to the longitudinal extension of the head whereas the length extension of the upper cross-sectional area may be substantially orthogonal/perpendicular thereto, i.e. the twisting angle α may be about 90°. Such a twisted tuft configuration may provide improved cleaning properties when the head is moved in the longitudinal brushing direction.

Test results of high speed brushing analysis revealed that filaments of twisted tufts having a twisting angle α of about 90° and an upper and a lower cross-sectional area substantially of a rectangle reached deeper into interdental areas and adapted better to the gingival marginal regions of the teeth compared to regular tufts composed of filaments extending from the mounting surface of the head in a substantially straight and perpendicular manner and being substantially parallel to one another. The length extensions of the lower cross-sectional areas of the twisted tufts were arranged on the mounting surface of the head in a substantially parallel manner with respect to the longitudinal extension of the head.

The high speed brushing analysis showed that the twisted tufts de-twisted when the twisted tufts came into contact with the teeth and the gingival marginal regions of the teeth. The de-twisting of the tufts occurred via at least a part of the twisting angle α and resulted in a tuft elongation. This tuft elongation enabled the filaments to penetrate deeper into the interdental areas and other hard to reach regions. When the head was moved along its longitudinal direction, the inclined arrangement of the filaments prevented the filaments from spreading and bending away and provided the twisted tuft with increased stiffness. The increased stiffness of the twisted tufts forced the filaments to penetrate into the interdental areas and resulted in improved interdental cleaning properties when the head was moved along the okklusal, labial and bukkal surfaces of the teeth.

In some embodiments, the outer lateral surface of the twisted tuft may comprise at least one lateral edge which is inclined with respect to the longitudinal axis of the twisted tuft by an edge inclination angle β. The at least one lateral edge extends from the base to the free end of the twisted tuft. Said lateral edge may be provided by an upper and a lower cross-sectional area having substantially the shape of a rectangle or square. The lateral edge may further facilitate the filaments forming said edge penetrating more easily into interdental areas and gaps.

In some embodiments, the edge inclination angle β may be from about 6° to about 25°, optionally from about 8° to about 16°, further optionally about 9°. In some embodiments, the edge inclination angle β may be about 9° and the upper and the lower cross-sectional area each may have substantially the shape of a rectangle and the twisting angle α may be of about 90°. Such a twisted tuft may show further improved interdental cleaning properties for a brushing movement which is along the length extension of the lower cross-sectional area.

In some embodiments, the head may have a distal end and a proximal end, and the lateral edge may be inclined in a direction towards the distal end or towards the proximal end. Such twisted tuft may provide improved interdental cleaning properties when the head is moved in the respective longitudinal brushing direction, i.e. towards the distal end or towards the proximal end.

In some embodiments, the outer lateral surface may comprise two lateral edges being inclined in opposite directions. A head comprising such twisted tuft may provide improved interdental cleaning properties when the head is moved in these opposite directions. In some embodiments, one lateral edge is inclined towards the distal end of the head and the other lateral edge is inclined towards the proximal end. A head comprising such twisted tuft may provide improved interdental cleaning properties when the head is moved in the longitudinal brushing direction, i.e. when the head is moved backward and forward.

In some embodiments, the head may comprise at least a first twisted tuft and a second twisted tuft and the upper cross-sectional area of the first twisted tuft may be twisted in a different direction than the upper cross-sectional area of the second twisted tuft. In other words, one of the twisted tufts may be twisted in the clockwise direction whereas the other twisted tuft may be twisted in the counterclockwise direction when the twisted tufts are seen from a top-down view along the longitudinal axes. Thus, a head may be provided having at least two twisted tufts, each twisted tuft providing distinct cleaning properties.

In some embodiments, the longitudinal axis of the twisted tuft may be inclined with respect to the mounting surface of the head by a tuft inclination angle γ. In other words, the twisted tuft/the longitudinal axis of the twisted tuft may be oriented at an angle γ relative to that portion of the mounting surface of the head from which it extends. The longitudinal axis of the twisted tuft may be angled relative to an imaginary line which is tangent to or co-planar with the mounting surface of the head through which the twisted tuft is secured to the head. The twisted tuft may be oriented at an angle γ in a direction that is substantially parallel to the longitudinal extension of the head, i.e. along the length of the head and/or orthogonal thereto, i.e. across the width of the head and/or part way between the length and the width of the head. In some embodiments, one or more twisted tufts may be tilted in a direction that is substantially parallel to the longitudinal extension of the head. The at least one inclined twisted tuft may further improve cleaning properties, for example with respect to interdental areas, as the inclination of the twisted tuft may further facilitate the filaments sliding into small gaps between the teeth to clean the interdental areas.

In some embodiments, the head comprises a plurality of twisted tufts, wherein at least one twisted tuft may be angled in a direction towards a proximal end of the head and at least one twisted tuft may be angled in a direction towards a distal end of the head. In the context of this disclosure the term "proximal end" means the end of the head which may be attached to a handle, whereas the term "distal end" means the end of the head which is opposite the proximal end, i.e. the free end of the head. This twisted tuft configuration may further facilitate the penetration of filaments into interdental areas when the head of the oral care implement is moved both, in a forward and a backward brushing direction along the longitudinal extension of the head. The opposite inclination directions of the twisted tufts may further force the filaments to slide into the interdental areas when the head is moved in these two opposite directions.

In addition, the upper cross-sectional areas of at least two twisted tufts may be twisted in opposite directions. These two twisted tufts may be in close proximity to form a pair of twisted tufts wherein both upper cross-sectional areas are aligned substantially in one row. In other words, a pair comprises two twisted tufts being arranged in close proximity and being inclined and twisted in opposite directions. This twisted tuft arrangement provides a criss-cross pattern which may improve synchronized interdental penetration of the filaments into interdental areas. Further, twisted tufts in such a criss-cross pattern allow a more space saving arrangement of the tufts compared to non-twisted tufts being arranged in such criss-cross pattern. In other words, according to the present disclosure, more tufts can be arranged on the mounting surface of the head compared to the usage of non-twisted tufts.

The cleaning efficiency may be even further improved if more than one row of angled twisted tufts is consecutively arranged. In some embodiments, the head may comprise a plurality of twisted tufts that may be arranged in at least a first row and a second row and the longitudinal axes of the twisted tufts of the first row may be inclined in a different direction than the longitudinal axes of the twisted tufts of the second row. In some embodiments, each row may be arranged substantially parallel to the longitudinal extension of the head and the longitudinal axes of the twisted tufts of the first row may be inclined towards the proximal end of the head and the longitudinal axes of the twisted tufts of the second row may be inclined towards the distal end of the head thereby providing a criss-cross pattern. Further, the longitudinal axes of the twisted tufts can also be oriented at two or more different angles γ and can also be angled in different directions such as along the length of the head, across the width of the head or part way between the length and the width of the head.

In some embodiments, the head may comprise a plurality of twisted tufts which may be arranged at the edge of the mounting surface of the head. In the context of this disclosure the term "edge of the mounting surface" means the most outer area of a tuft configuration which may be in close proximity to the outer circumference of the head. In some embodiments, the head and its mounting surface may have a substantially circular or oval shape. Such a head may be provided for an electrical toothbrush which may perform a rotational oscillation movement. The head of an electrical toothbrush can be driven to rotate about and to move axially along an axis of movement in an oscillating manner, wherein such axis of movement may extend substantially perpendicular to the plane defined by the mounting surface of the head. In some embodiments, a plurality of twisted tufts may be inclined with respect to the mounting surface from which they extend in an alternating manner. Such a twisted tuft configuration may allow the filaments to penetrate into inderdental areas and hard to reach regions more easily during the rotational oscillation movement of the head which may provide further improved cleaning properties of the head.

The tuft inclination angle $\gamma$ between the longitudinal axis of the twisted tuft and the mounting surface of the head may be from about 45° to about 89°, optionally from about 60° to about 85°, further optionally from about 65° to about 83°, even further optionally from about 70° to about 80°, even further optionally from about 72° to about 78°, even further optionally about 74°, about 75° or about 76°.

Experiments revealed that filaments having an inclination angle $\gamma$ from about 65° to about 80°, optionally from about 70° to about 80° are more likely to penetrate into interdental gaps. Filaments having an inclination angle $\gamma$ of more than about 80° showed low likelihood of interdental penetration as these filaments bend away from the direction of travel or skip over the teeth. Surprisingly, it was found, that filaments having an inclination angle $\gamma$ of about 74° may further improve cleaning performance of the head for an oral care implement. Experiments revealed that such filaments are even more likely to penetrate into interdental gaps.

In some embodiments, the at least one twisted tuft may be attached/secured to the head by means of a hot tufting process. One method of manufacturing the head of an oral care implement may comprise the following steps: Firstly, the at least one twisted tuft may be formed by providing a desired amount of filaments. Secondly, the twisted tuft may be placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. Thirdly, the head or an oral care implement body comprising the head and the handle may be formed around the ends of the filaments extending into the mold cavity by an injection molding process, thereby anchoring the at least one twisted tuft in the head. Alternatively, the twisted tuft may be anchored by forming a first part of the head—a so called "sealplate"—around the ends of the filaments extending into the mold cavity by an injection molding process before the remaining part of the oral care implement may be formed. Before starting the injection molding process, the ends of the at least one twisted tuft extending into the mold cavity may be optionally melted or fusion-bonded to join the filaments together in a fused mass or ball so that the fused masses or balls are located within the cavity. The at least one twisted tuft may be held in the mold cavity by a mold bar having blind holes that correspond to the desired position of the twisted tuft on the finished head of the oral care implement. In other words, the filaments of the at least one twisted tuft attached to the head by means of a hot tufting process are not doubled over a middle portion along their length and are not mounted in the head by using an anchor/staple. The at least one twisted tuft may be mounted on the head by means of an anchor-free tufting process.

The twisted tuft may have a specific topography/geometry at its free end, i.e. at its upper top surface, which may be shaped to optimally adapt to the teeth's contour and to further enhance interdental penetration. For example, the topography may be chamfered or rounded in one or two directions, pointed or may be formed linear, concave or convex.

The filaments may be made of nylon with or without an abrasive such as kaolin clay, polybutylene terephtalate (PBT) with or without an abrasive such as kaolin clay and/or from nylon indicator material colored at the outer surface. The coloring on the nylon indicator material may be slowly worn away as the filament is used over time to indicate the extent to which the filament is worn. At least some of the filaments may have a substantially cylindrical shape or may comprise a tapered/pointed tip to provide gentle cleaning properties.

The oral care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The following is a non-limiting discussion of example embodiments of oral care implements and parts thereof in accordance with the present disclosure, where reference to the Figures is made.

FIG. 1 shows a perspective view of a first embodiment of an oral care implement 10 which could be a manual or an electrical toothbrush 10 comprising a handle 12 and a head 14 extending from the handle 12 in a longitudinal direction. The head 14 has a proximal end 41 close to the handle 12 and a distal end 40 furthest away from the handle 12, i.e. opposite the proximal end 41. The head 14 has substantially the shape of an oval with a length extension 52 and a width extension 51 substantially perpendicular to the length extension 52. A plurality of twisted tufts 16 is secured to the head 14 at the tuft's base 20 by means of a hot tufting process. The twisted tufts 16 extend from a mounting surface 18 of the head 14 in a substantially orthogonal manner.

Figure 2:
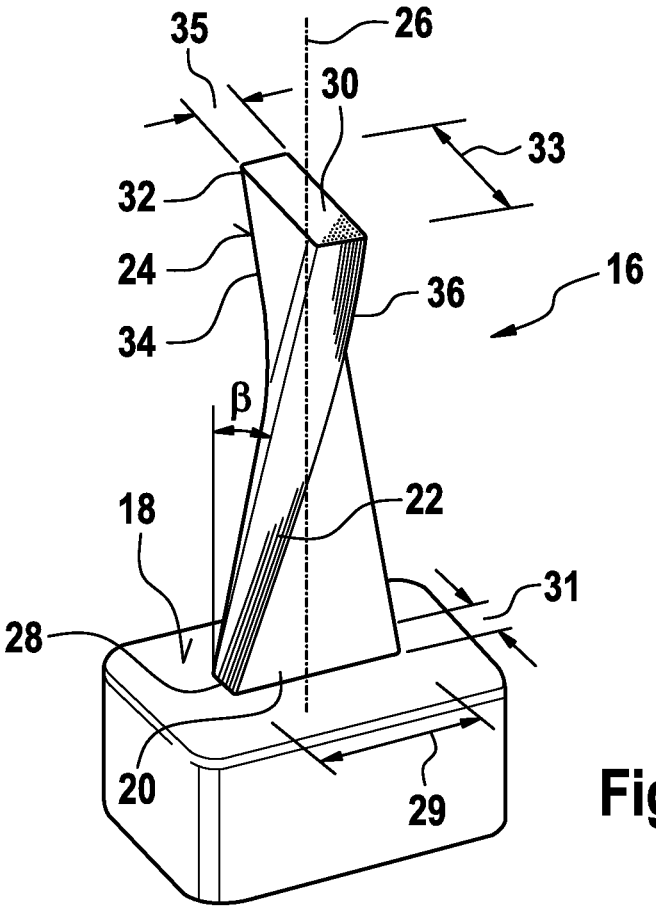
FIG. 2 shows a schematic perspective view of an example embodiment of a twisted tuft shown in FIG. 1.
Figure 3:
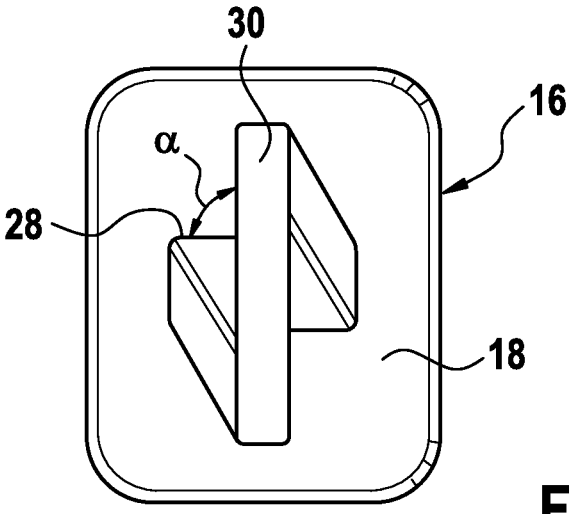
FIG. 3 shows a schematic top-down view of the twisted tuft of FIG. 2.

A twisted tuft 16 comprising a plurality of filaments 22 and being attached to the head 14 of the first embodiment is illustrated in FIGS. 2 and 3. The twisted tuft 16 has an outer lateral surface 24, a longitudinal axis 26, a lower cross-sectional area 28 and an upper cross-sectional area 30. Both cross-sectional areas 28, 30 have substantially the shape of a rectangle with a length extension 29, 33 and a width extension 31, 35 being substantially orthogonal to the length extension 29, 33. The lower cross-sectional area 28 extends in a plane that is perpendicular to the longitudinal axis 26 of the twisted tuft 16 and is arranged at the twisted tuft's base 20. The upper cross-sectional area 30 extends also in a plane perpendicular to the longitudinal axis 26 and is arranged at the tuft's free end 32. At least the filaments 22 forming the outer lateral surface 24 of the twisted tuft 16 are substantially straight and inclined with respect to the longitudinal axis 26 in a clockwise or counterclockwise direction. The upper cross-sectional area 30 is twisted with respect to the lower cross-sectional area 28 by a twisting angle $\alpha$ of about 90°. However, the twisting angle $\alpha$ may be also of about 1° to about 120° or from about 50° to about 100°. When seen from a top down-view (cf. FIG. 3), i.e. when both cross-sectional areas 28, 30 are orthogonally projected onto each other along the longitudinal axis 26 of the twisted tuft 16, the upper cross-sectional area 30 is not congruent with the lower cross-sectional area 28.

The outer lateral surface 24 of the twisted tuft 16 comprises two lateral edges 34, 36 being inclined in opposite directions and extending from the base 20 to the free end 32 of the twisted tuft 16. The lateral edges 34, 36 are inclined with respect to the longitudinal axis 26 of the twisted tuft 16 by an edge inclination angle $\beta$ of about 9°. However, a twisted tuft configuration may also have an edge inclination angle β from about 6° to about 25° or from about 8° to about 16°. Both lateral edges 34, 36 are inclined in a direction along the length extension 29 of the lower cross-sectional area 28.

The head 14 of the oral care implement 10 shown in FIG. 1 comprises two rows 44, 46 of twisted tufts 16 being arranged at the edge 42 of the mounting surface 18 along the length extension 52 of the head 14. The upper cross-sectional areas 30 of the twisted tufts 16 of the first row 44 are twisted in a different, i.e. in the opposite direction than the upper cross-sectional areas 30 of the twisted tufts 16 of the second row 46. The length extensions 29 of the lower cross-sectional areas 28 are arranged part way between the width extension 51 and the length extension 52 of the head 14.

A third row 48 of tufts 50 with a substantially rectangular cross-sectional area is arranged in the central part of the mounting surface 18 between the first and the second row 44, 46 along the length extension 52 of the head 14. All tufts 50 of the third row 48 extend from the mounting surface 18 in a substantially orthogonal manner.

Further, the head 14 shown in FIG. 1 comprises one crescent-shaped tuft 38 which is attached to the head 14 in the toe region at the distal end 40 of the head 14, i.e. furthest away from the handle 12. The crescent-shaped tuft 38 may be angled by about 80° or less to an imaginary line which is tangent to or co-planar with the mounting surface 18 of the head 14 through which the crescent-shaped tuft 38 is secured to the head 14. The crescent-shaped tuft 38 is tilted/angled away from the handle 12. The crescent-shaped tuft 38 extends past the distal end 40 of the head 14 of the oral care implement 10 and, thus, may clean molars (e.g. wisdom teeth and second molars) in the back of the oral cavity in a more sufficient manner. The crescent-shaped tuft 38 may have a cross-section which is at least four times as large as any other tuft 16, 50 secured to the head 14.

Figure 4:
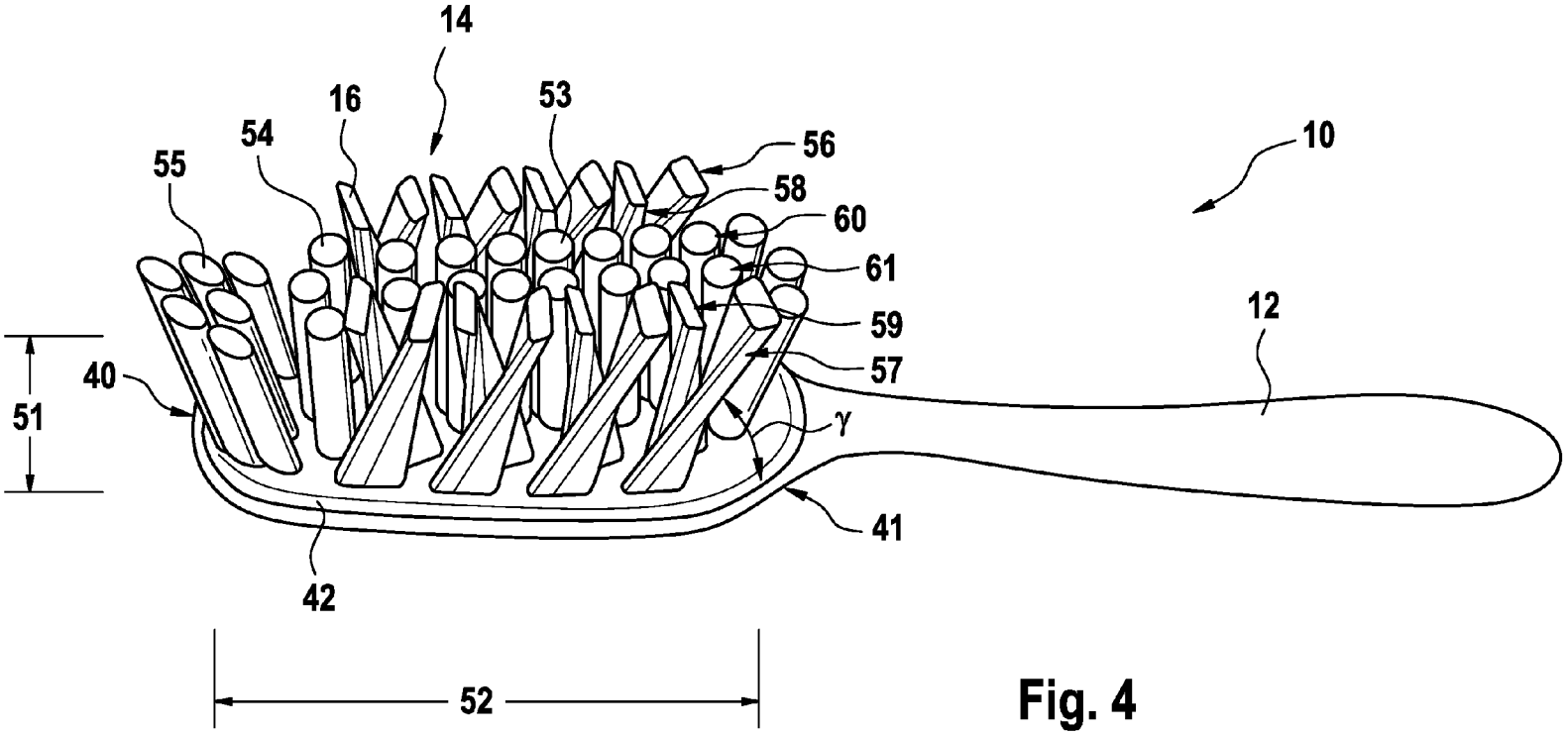
FIG. 4 shows a schematic perspective view of a second example embodiment of an oral care implement comprising a second example embodiment of a head.

FIG. 4 shows a second embodiment of an oral care implement 10, which could be a manual or an electrical toothbrush 10 comprising a handle 12 and a substantially oval head 14 extending from the handle 12 in a longitudinal direction. Four different types of tufts 16, 53, 54, 55 are secured to the head 14 by means of a hot tufting process and extend from the mounting surface 18 of the head 14.

Four rows 56, 57, 58, 59 of twisted tufts 16 (as shown in FIGS. 2 and 3 but being inclined with respect to the mounting surface) are each arranged along the length extension 52 of the head 14. Tow outer rows 56, 57 are arranged at the edge 42 of the mounting surface 18 and two inner rows 58, 59 are arranged next to the outer rows 56, 57.

In contrast to the twisted tuft shown in FIGS. 2 and 3, the longitudinal axes 26 of the twisted tufts 16 are all inclined with respect to the mounting surface 18 by a tuft inclination angle 7 of about 74°. However, the tuft inclination angle γ may also be from about 45° to about 89° or from about 70° to about 80°. The longitudinal axes 26 of the twisted tufts 16 of the outer rows 56, 57 are all inclined towards the proximal end 41 of the head 14 whereas the longitudinal axes 26 of the twisted tufts 16 of the inner rows 58, 59 are all inclined in the opposite direction, i.e. towards the distal end 40, thereby defining a criss-cross pattern of the twisted tufts 16.

The upper cross-sectional areas 30 of the twisted tufts 16 of the outer rows 56, 57 are twisted in a different, i.e. in the opposite direction than the upper cross-sectional areas 30 of the twisted tufts 16 of the inner rows 58, 59. The length extensions 29 of the lower cross-sectional areas 28 of all twisted tufts 16 are arranged substantially parallel to the length extension 52 of the head 14. Thus, one lateral edge 34 of each twisted tuft 16 is inclined in a direction towards the distal end 40 of the head 14 and one lateral edge 36 is inclined in a direction towards the proximal end 41 of the head 14.

This results in a twisted tuft configuration wherein the length extensions 33 of the upper cross-sectional areas 30 of all twisted tufts 16 are arranged substantially parallel to the width extension 51 of the head 14.

Each twisted tuft 16 of the inner row 58, 59 form a pair with a twisted tuft 16 of the respective outer row 56, 57 which is in its close proximity. In other words, a pair comprises two twisted tufts 16 being inclined and twisted in opposite directions. Due to said inclined and twisted configuration of the tufts 16, all upper cross-sectional areas 30 of the tufts 16 of the respective inner and outer rows 56, 57, 58, 59 are aligned substantially in one row. In other words, the twisted tufts 16 are arranged in a manner that the upper cross-sectional areas 30 of the twisted tufts 16 of the inner and outer row 56, 58 at one side of the head 14 and the upper cross-sectional areas 30 of the twisted tufts 16 of the inner and outer row 56, 58 at the other side of the head may each define a row/line which is substantially along the length extension 52 of the head 14 to improve synchronized interdental penetration of the filaments of the twisted tufts 16. Further, twisted tufts 16 in a criss-cross pattern allow a more space saving arrangement of the tufts compared to non-twisted tufts being arranged in such a criss-cross pattern. In other words, according to the present disclosure, more tufts 16 can be arranged on the mounting surface 18 of the head 14 compared to the usage of non-twisted tufts.

A fifth row 60 and a sixth row 61 of tufts 53 with a substantially circular cross-sectional area are arranged between the inner rows 58, 59 in the central part of the mounting surface 18 along the length extension 52 of the head 14. All tufts 53 of the fifth and a sixth rows 60, 61 extend from the mounting surface 18 in a substantially orthogonal manner.

Further tufts 54 having a substantially circular cross-sectional area and extending from the mounting surface 18 in a substantially orthogonal manner are arranged at the respective ends of the fifth and sixth rows 60, 61.

A fourth type of tufts 55 having a substantially circular cross-sectional area and being inclined with respect to the mounting surface 18 is arranged in the toe region at the distal end 40 of the head 14, i.e. furthest away from the handle 12, in a crescent-shaped form as described with respect to FIG. 1.

Figure 5:
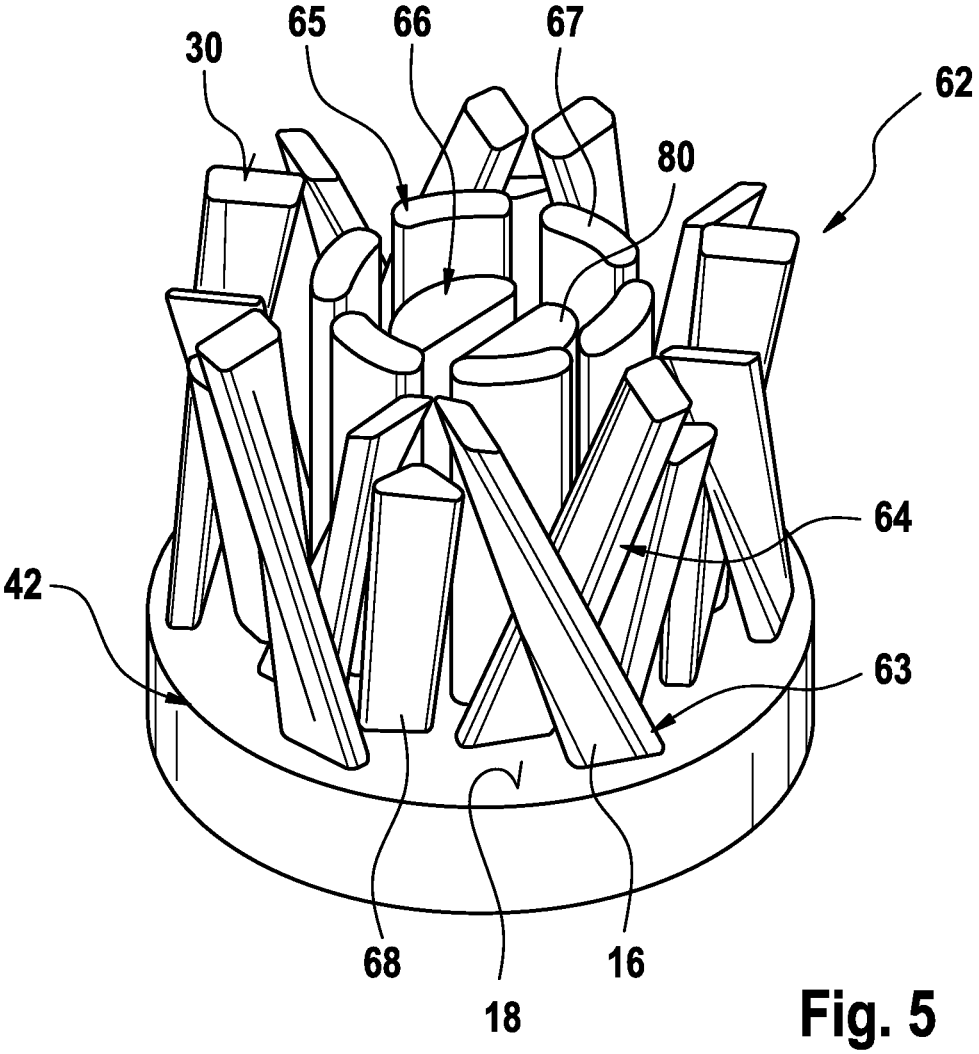
FIG. 5 shows a schematic perspective view of a third example embodiment of a head.

FIG. 5 shows a third embodiment of a head 62 for an oral care implement 10, which could be an electrical toothbrush 10 which may perform a rotational oscillation movement of the head 62. The head 62 has a substantially circular shape to which a plurality of twisted tufts 16 and further tufts 67, 68 are secured by means of a hot tufting process. The twisted tufts 16 are arranged in an outer ring 63 along the edge 42 of the mounting surface 18 and in an inner ring 64 which is in close proximity to the outer ring 63. The twisted tufts 16 of the inner and outer rings 63, 64 are twisted and inclined in a similar manner as described with respect to the inner and outer rows 56, 57, 58, 59 of FIG. 4. The twisted tufts 16 of the inner ring 63 are twisted and inclined in the opposite direction than the twisted tufts 16 of the outer ring 64, thereby defining a criss-cross pattern.

Each twisted tuft 16 of the inner ring 63 form a pair with a twisted tuft 16 of the outer ring 64 which is in its close proximity. In other words, a pair comprises two twisted tufts 16 being inclined and twisted in opposite directions. Due to said inclined and twisted configuration of the tufts 16, all upper cross-sectional areas 30 of the tufts 16 of the inner and the outer ring 63, 64 are aligned substantially in one single ring/circle. In other words, the twisted tufts 16 are arranged in a manner that the upper cross-sectional areas 30 of the twisted tufts 16 of the inner and outer rings 63, 64 may form a single ring/circle which is arranged along the edge 42 of the mounting surface 18. Such alignment of the twisted tufts 16 may improve synchronized interdental penetration of the filaments 22 of the twisted tufts 16. Further, twisted tufts 16 in a criss-cross pattern allow a more space saving arrangement of the tufts compared to non-twisted tufts being arranged in such a criss-cross pattern. In other words, according to the present disclosure, more tufts 16 can be arranged on the mounting surface 18 of the head 62 compared to the usage of non-twisted tufts.

Two further rings 65, 66 of tufts 67, 80 with a substantially rectangular, oval and/or semi-circular cross-sectional area are arranged in the central part of the mounting surface 18. All tufts 67, 80 of the two further rings 65, 66 extend from the mounting surface 18 in a substantially orthogonal manner.

In addition, further tufts 68 having a substantially triangular cross-sectional shape may be arranged between two pairs of twisted tufts 16, i.e. between two tufts 16 which are inclined towards each other. These further tufts 68 may be inclined with respect to the mounting surface 18 from which they extend in a direction towards the edge 42 of the mounting surface 18.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A head for an oral care implement comprising:

a mounting surface and a plurality of twisted tufts, each comprising a plurality of filaments and having a base mounted on the mounting surface, each of the twisted tufts having an outer lateral surface, a longitudinal axis, a lower cross-sectional area adjacent to the base, and an upper cross-sectional area adjacent to a free end of the twisted tuft, the lower cross-sectional area and the upper cross-sectional area having substantially the same shape and size, wherein at least the filaments forming the outer lateral surface are each substantially straight and are all inclined with respect to the longitudinal axis in either a clockwise direction or a counterclockwise direction, and the upper cross-sectional area is twisted with respect to the lower cross-sectional area by a twisting angle $\alpha$, and the upper cross-sectional area is not congruent with the lower cross-sectional area when they are orthogonally projected onto each other along the longitudinal axis, wherein the plurality of twisted tufts is arranged in at least a first row and a second row, and wherein the longitudinal axes of the twisted tufts of the first row are inclined in a first direction while the longitudinal axes of the twisted tufts of the second row are inclined in a second direction different from the first direction.

2. A head according to claim 1, wherein the twisting angle $\alpha$ is from about 1° to about 120°.

3. A head according to claim 1, wherein the twisting angle $\alpha$ is about 90°.

4. A head according to claim 1, wherein the lower and the upper cross-sectional area each have substantially the shape of a rectangle.

5. A head according to claim 1, wherein the outer lateral surface comprises at least one lateral edge extending from the base to the free end and being inclined with respect to the longitudinal axis of the twisted tuft by an edge inclination angle $\beta$.

6. A head according to claim 5, wherein the edge inclination angle $\beta$ is from about 6° to about 25°, optionally from about 8° to about 16°, further optionally about 9°.

7. A head according to claim 6, wherein the head has a distal end and a proximal end, and the lateral edge is inclined in a direction towards the distal end or towards the proximal end.

8. A head according to claim 5, wherein the head has a distal end and a proximal end, and the lateral edge is inclined in a direction towards the distal end or towards the proximal end.

9. A head according to claim 5, wherein the outer lateral surface comprises two lateral edges being inclined in opposite directions.

10. A head according to claim 1, wherein the head comprises at least a first twisted tuft and a second twisted tuft, the upper cross-sectional area of the first twisted tuft being twisted in a different direction than the upper cross-sectional area of the second twisted tuft.

11. A head according to claim 1, wherein the longitudinal axis of the twisted tuft is inclined with respect to the mounting surface of the head by a tuft inclination angle $\gamma$.

12. A head according to claim 11, wherein the tuft inclination angle $\gamma$ is from about 45° to about 89°.

13. A head according to claim 10, wherein the tuft inclination angle $\gamma$ is from about 70° to about 80°.

14. A head according to claim 1, wherein the head comprises a plurality of twisted tufts arranged at the edge of the mounting surface.

15. A head according to claim 1, wherein the at least one twisted tuft is attached to the head by a hot-tufting process.

16. A head according to claim 1, wherein the twisting angle $\alpha$ is from about 50° to about 100°.

17. The head according to claim 1, wherein the first direction is opposite to the second direction.

18. The head according to claim 17, wherein the head has a distal end and a proximal end opposite to the distal end, and wherein the first direction is a direction towards the distal end and the second direction is a direction towards the proximal end.

19. The head according to claim 1, wherein the twisted tufts of the first row are twisted in a direction opposite to a direction in which the twisted tufts of the second row are twisted.

20. The head according to claim 19, wherein the first row is adjacent to the second row and wherein the twisted tufts of the first row and the twisted tufts of the second row form at least one pair comprising one twisted tuft of the first row and one twisted tuft of the second rows, the twisted tufts in the at least one pair being inclined and twisted in opposite directions so that the upper cross-sectional areas of the tufts of said pair are aligned substantially in one row.

21. The head according to claim 19, wherein the first row is adjacent to the second row and wherein the twisted tufts of the first row and the twisted tufts of the second row form a plurality of pairs of twisted tufts, each pair comprising one twisted tuft of the first row and one twisted tuft of the second rows, the twisted tufts in each pair being inclined and twisted in opposite directions so that the upper cross-sectional areas of the tufts of the first row and the upper cross-sectional areas of the tufts of the second row are aligned in substantially one row.

22. The head according to claim 21, wherein the upper cross-sectional area of each of the twisted tufts has a length extension and a width extension perpendicular to the length extension, the length extension being longer than the width extension, and wherein the length extensions of the upper cross-sectional areas of the plurality of twisted tufts of the first row and the length extensions of the upper cross-sectional areas of the plurality of twisted tufts of the second row are oriented parallel to one another.

23. An oral care implement comprising a head according to claim 1.

* * * * *